US009273515B2

(12) United States Patent
O'Grady, Sr.

(10) Patent No.: US 9,273,515 B2
(45) Date of Patent: Mar. 1, 2016

(54) ROOFING LADDER WITH A MODULAR ANGULARLY ADJUSTABLE PLATFORM

(71) Applicant: Kevin John O'Grady, Sr., Union, NJ (US)

(72) Inventor: Kevin John O'Grady, Sr., Union, NJ (US)

( * ) Notice: Subject to any disclaimer, the term of this patent is extended or adjusted under 35 U.S.C. 154(b) by 78 days.

(21) Appl. No.: 14/179,006

(22) Filed: Feb. 12, 2014

(65) Prior Publication Data

US 2015/0225969 A1 Aug. 13, 2015

(51) Int. Cl.

| | |
|---|---|
| ***E06C 1/36*** | (2006.01) |
| ***E04G 3/26*** | (2006.01) |
| ***E06C 1/34*** | (2006.01) |
| ***E06C 1/38*** | (2006.01) |
| ***E06C 7/16*** | (2006.01) |
| ***E06C 7/48*** | (2006.01) |

(52) U.S. Cl.
CPC . *E06C 1/36* (2013.01); *E04G 3/265* (2013.01); *E06C 1/345* (2013.01); *E06C 1/381* (2013.01); *E06C 7/165* (2013.01); *E06C 7/488* (2013.01)

(58) Field of Classification Search
CPC ..... E06C 1/36; E06C 1/345; E06C 1/48; E06C 1/488
See application file for complete search history.

(56) References Cited

U.S. PATENT DOCUMENTS

| | | | | | |
|---|---|---|---|---|---|
| 362,747 | A * | 5/1887 | Higgins | 248/237 |
| 1,016,935 | A * | 2/1912 | Clark | 280/43 |
| 2,052,439 | A * | 8/1936 | Bailey | 182/189 |
| 2,476,401 | A * | 7/1949 | Campion | 182/45 |
| 3,019,851 | A * | 2/1962 | Doss | 182/111 |
| 4,002,223 | A * | 1/1977 | Bernkrant | 182/156 |
| 4,143,743 | A * | 3/1979 | Larson | 182/206 |
| 4,450,935 | A * | 5/1984 | Gustavus | 182/45 |
| 4,458,783 | A * | 7/1984 | Stakes | 182/206 |
| 4,695,023 | A * | 9/1987 | McCafferty | 248/238 |
| 4,724,925 | A * | 2/1988 | Ritten | 182/97 |
| 4,785,606 | A * | 11/1988 | Burton | 52/749.12 |
| 4,972,922 | A * | 11/1990 | Levine | 182/45 |
| 5,624,006 | A * | 4/1997 | Richardson, Jr. | 182/45 |
| 6,045,102 | A * | 4/2000 | Terenzoni | 248/238 |
| 6,092,624 | A * | 7/2000 | Slater | 182/45 |
| 6,360,845 | B1 * | 3/2002 | Allison | 182/107 |
| 8,857,568 | B2 * | 10/2014 | Foster et al. | 182/45 |
| 2005/0194212 | A1 * | 9/2005 | Board et al. | 182/45 |
| 2014/0008150 | A1 * | 1/2014 | Baglin | 182/129 |
| 2015/0068839 | A1 * | 3/2015 | Webster et al. | 182/45 |

FOREIGN PATENT DOCUMENTS

| | | | | |
|---|---|---|---|---|
| FR | 2597920 | A1 * | 10/1987 | E06C 7/48 |

* cited by examiner

*Primary Examiner* — Colleen M Chavchavadze

(57) ABSTRACT

A roofing ladder with a modular angularly adjustable platform facilitates roofing work by providing a platform assembly which can be adjusted angularly to provide a desired slope for sitting or standing on or for storing tools or supplies. A beam provides structural support. A roof anchor hook connected to the beam contacts the opposing roofing surface to hold the ladder in place. A wheel assembly allows a user to easily mount the ladder on a roof. A plurality of step rods laterally connected to the beam provides steps for climbing the ladder as well as attachment locations for the platform assembly. A plurality of beam lifters provides a means to lift the beam off the roof surface for performing work on the roof surface underneath the beam. An extension slot allows the ladder to be extended for longer roofs or more easily manipulated into place using an extension pole.

18 Claims, 17 Drawing Sheets

ROOFING LADDER WITH A MODULAR ANGULARLY ADJUSTABLE PLATFORM

The current application claims a priority to the U.S. Provisional Patent application Ser. No. 61/763,713 filed on Feb. 12, 2013.

FIELD OF THE INVENTION

The present invention relates generally to ladders. More particularly, the present invention is a roofing ladder with a modular angularly adjustable platform.

BACKGROUND OF THE INVENTION

Ladders have long allowed workers to access areas at heights that would otherwise be far beyond their reach. Many different ladders exist and are in wide use in the world today. These ladders range from stand alone ladders that are ideal for accessing ceilings inside of structures to long extendable ladders that are commonly used by painters to access the high walls of buildings and houses. There is furthermore another type of ladder that has emerged over time; the roofing ladder. When performing roofing tasks, a worker needs a way to safely ascend and descend along a roof. As most roofs are angled triangles, this can become quite difficult if the angle of the roof is very steep. To rectify this issue, roofing ladders have been developed and are available on the current market. Several of these roofing ladders make use of a hook type system that uses the ridge of the roof to bear the weight of the ladder and any worker climbing that ladder. Such roofing ladders are much more effective at allowing the worker to ascend and descend along the roof and are designed specifically to be mounted on a roof.

Although roofing ladders are designed to be used on a roof, they suffer from several disadvantages. These disadvantages include the fact that the roofing ladder can be very difficult to place, and that most roofing ladders come into direct contact with the surface of the roof, making it difficult to work underneath the roofing ladder. Furthermore, most roofing ladders are of a set length, meaning that the worker is out of luck if their ladder is too short for the roof they are working on. The present invention aims to correct these shortcomings in current roofing ladders by introducing a roofing ladder with multi-angle seat. It is an object of the present invention to be light, easy to use, to be easily slid into place on the roof, and to posses optional extensions to adapt to roofs of various sizes. It is a further object of the present invention to maintain some distance from the surface of the roof such that the worker may do work underneath the present invention. Additionally, the present invention aims to provide a modular seat which can be placed anywhere along the ladder and is adjustable to accommodate varying roof angles to provide a worker with convenient and level platform to work from, thus making the present invention a vast and non obvious improvement upon existing roofing ladders.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

Figure 1:
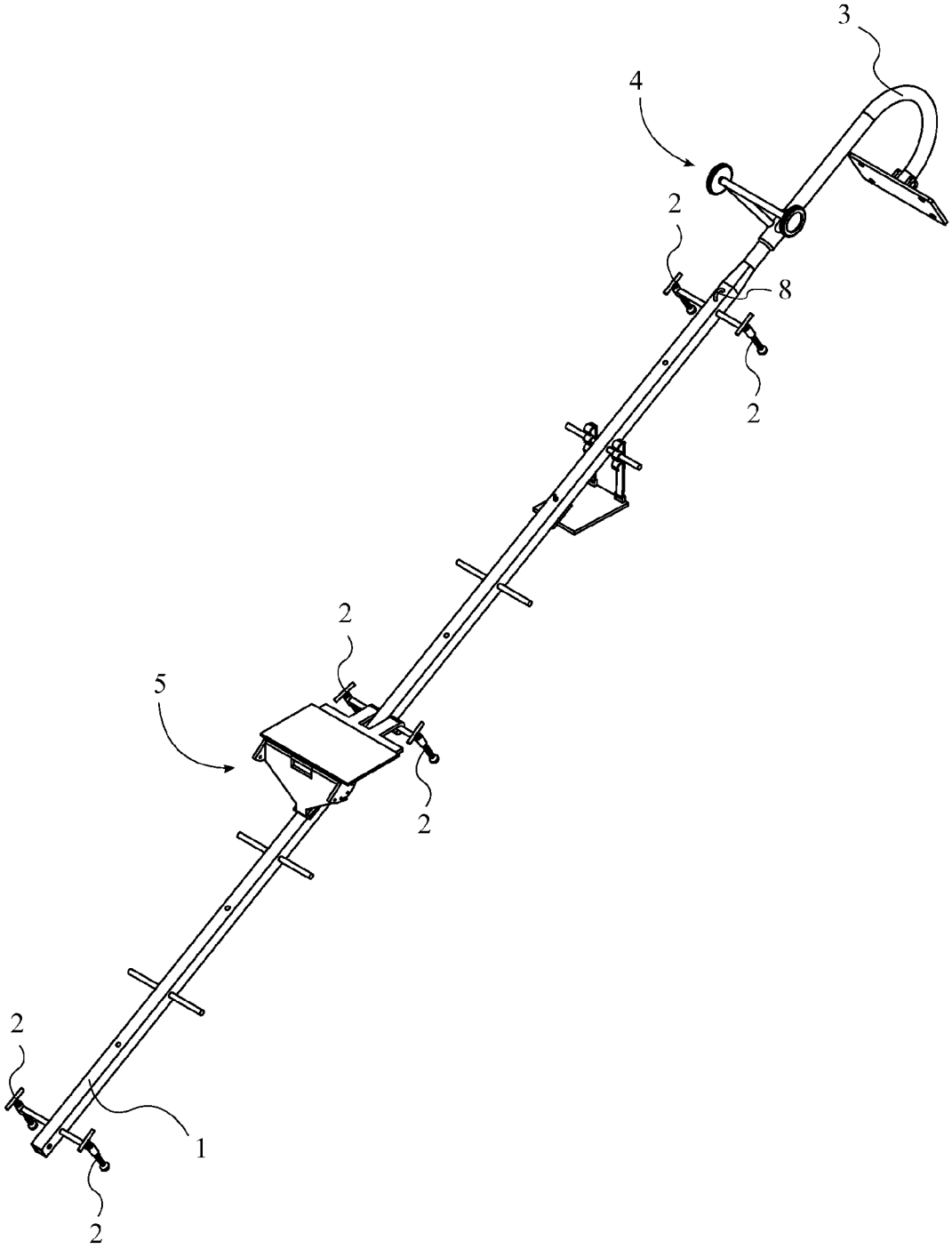
FIG. 1 is a perspective view of the present invention.

The present invention is a roofing ladder with an angularly adjustable platform. The present invention seeks to provide improved position customization ability for facilitating performing roofing work. In general, in the preferred embodiment, the present invention comprises a beam 1, a plurality of beam lifters 2, a roof anchor hook 3, a wheel assembly 4, and a platform assembly 5, as seen in FIG. 1.

The beam 1 is the central component of the present invention, with all other components being attached to the beam 1 in various ways for accomplishing the purposes of the present invention. The beam 1 is an elongated structural element and preferably has a rectangular or square cross section, though a different cross section such as a circular cross section may be utilized if deemed appropriate. However, hereinafter the beam 1 is assumed to have a square cross section. The main purpose of the beam 1 is to bear loads associated with a user climbing or sitting on the present invention. Such loads are transmitted into the beam 1 via other components of the present invention and it is important that the loads do not structurally compromise the beam 1. The material composition of the beam 1 may vary largely, anywhere from steel to aluminum and possibly even plastics, although it is most likely the beam 1 is manufactured from metals which can bear much higher bending moments. The beam 1 may or may not be hollow; this depends upon the required strength of the beam 1 and is something that is expected to vary in manufacturing. If possible, the beam 1 being hollow is ideal for the purposes of the beam 1 which involve the user physically maneuvering the beam 1 into place on a roof. The lighter the beam 1 is, the easier it is to maneuver the present invention into place.

Figure 2:
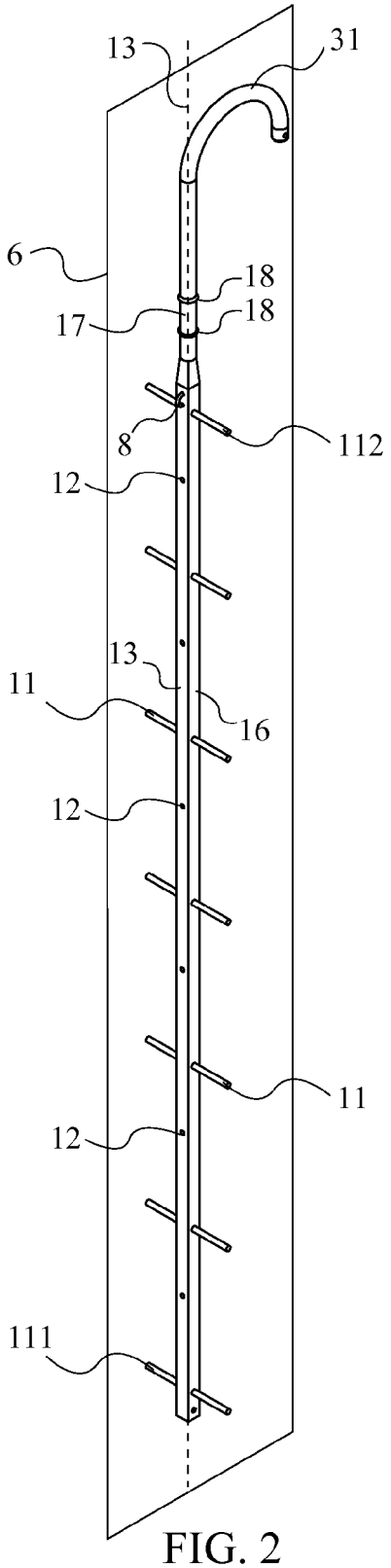
FIG. 2 is a perspective view of the beam.
Figure 3:
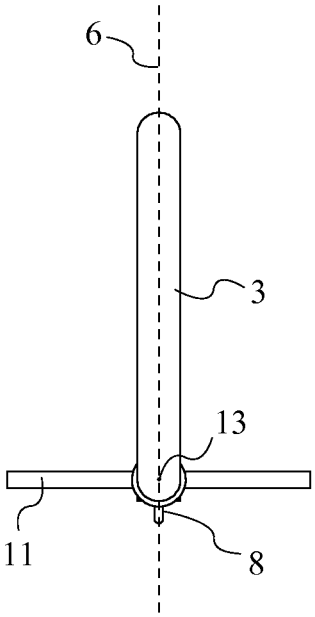
FIG. 3 is a top side view of the beam.

In reference to FIGS. 2-3, the beam 1 comprises a plurality of step rods 11 and a plurality of beam pin holes 12. A central axis 13 of the beam 1 centrally traverses along the length of the beam 1. Additionally, a symmetry reference plane 6 is defined as containing the central axis 13 and a normal vector to a topside face 14 and an underside face 15 of the beam 1, wherein the topside face 14 and the underside face 15 are connected by two lateral faces 16 in accordance with a square cross section. The beam 1 is symmetric about the symmetry reference plane 6, wherein the two lateral faces 16 are equidistant from each other across the symmetry reference plane 6. In the preferred embodiment, all components of the present invention are symmetric about the symmetry reference plane 6, including, but not limited to, the roof anchor hook 3, the platform assembly 5, the wheel assembly 4, and the plurality of beam lifters 2. While this is ideal in order to promote proper balance while performing roofing work, it should not be considered of utmost importance to the function of the present invention, and it is contemplated that alternate embodiments may utilize asymmetric arrangements or other components that alternately facilitate the intended function of the present invention.

The plurality of step rods 11 are connected to the beam 1, and spaced apart from each other along the length of the beam 1, providing hand and foot holds so that a user may climb the beam 1 as a ladder. Preferably, the plurality of step rods 11 are equally spaced apart from each other along the beam 1. More particularly, in the preferred embodiment of the present invention each of the plurality of step rods 11 is perpendicularly connected to one of the lateral faces 16 of the beam 1, wherein each of the plurality of step rods 11 is oriented perpendicular to the symmetry reference plane 6. Each of the plurality of beam pin holes 12 traverses perpendicularly through the topside face 14 and the underside face 15 and is oriented perpendicular to the central axis 13 of the beam 1 and to the plurality of step rods 11, wherein each of the plurality of beam pin holes 12 is oriented parallel to the symmetry reference plane 6. The plurality of step rods 11 and the plurality of beam pin holes 12 are alternatingly arranged along the beam 1; each of the plurality of beam pin holes 12 is positioned between two of the plurality of step rods 11. The purpose of the plurality of beam pin holes 12 is to allow a pin to secure a component of the platform assembly 5 to the beam 1.

A first step rod 111 from the plurality of step rods 11 and a last step rod 112 from the plurality of step rods 11 are positioned opposite each other along the length of the beam 1, with the rest of the plurality of step rods 11 between the first step rod 111 and the last step rod 112. In the preferred embodiment of the present invention, the plurality of step rods 11 comprises a plurality of step rod pairs. Each of the plurality of step rod pairs is perpendicularly connected to the beam 1, positioned coaxially with each other, and positioned on opposing lateral faces 16 the beam 1, forming a cross shape. It is contemplated that in an alternate embodiment, the plurality of step rods 11 may be positioned in an alternating zig-zag arrangement along the length of the ladder, alternating between one lateral face 16 and the other lateral face. However, this is not ideal, and hereinafter it is assumed that each successive placement of step rods 11 comprises the aforementioned cross shape. Each successive step rod placement may be thought of as one singular rod thrust laterally through the beam 1, though in manufacturing separate rods may be affixed to both lateral faces 16 of the beam 1 if desired to achieve the same effect.

The function of the plurality of beam lifters 2 is twofold: first, to assist in stabilizing the beam 1 against longitudinal rotation by making contact with the roof and supporting a portion of any loads applied to the beam 1 by a user or materials resting atop the present invention while in use. Secondly, the plurality of beam lifters 2 enable the beam 1 to be lifted away from the surface of the roof in order to work on the roof directly underneath portions of the present invention that would otherwise be in contact with the roof or positioned too close to the roof for a user to work. Such a function can be highly useful when performing roofing work such as applying shingles to the roof. In an alternate embodiment, these aforementioned functions may be accomplished using separate components: a stabilizing component and a lifting apparatus. An alternate stabilizing component may involve a step rod comprising additional material in the form of a 90 degree bend (or less) which turns the step rod toward making contact with the roof, providing lateral stabilization. An alternate lifting component may be connected to the underside face 15 of the beam 1, or may connected to a step rod and used in conjunction with the alternate stabilizing component.

Figure 4:
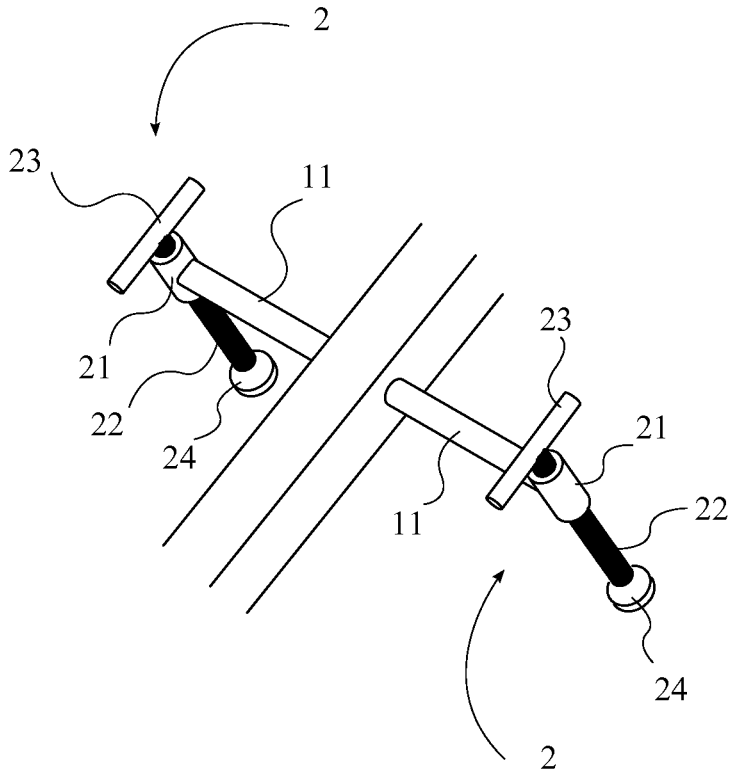
FIG. 4 is a perspective detail view of a pair of beam lifters.
Figure 17:
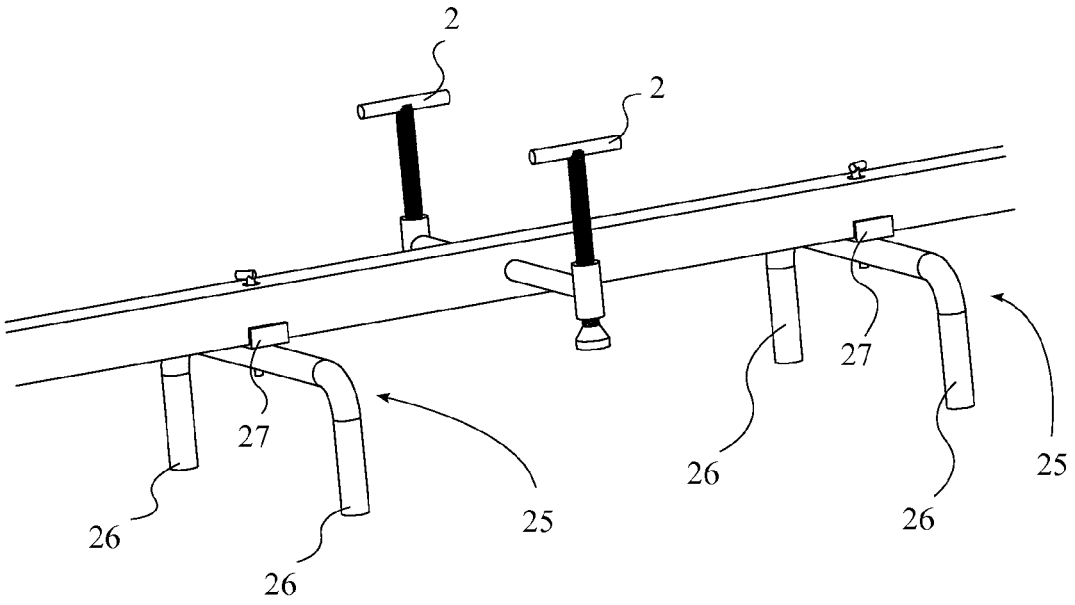
FIG. 17 is a side perspective view of two portable beam supports lifting the beam in place of beam lifters.

In reference to FIG. 17. an additional component which can be utilized along with the beam lifters 2 is a portable beam support 25. The portable beam support 25 is essentially a detachable U-shaped leg which can be affixed to the underside face 15 of the beam 1 to provide support to the beam 1. The portable beam support 25 is used when work needs to be done underneath a set of beam lifters 2. To use the portable beam support, a set of beam lifters 2 is operated in order to lift the beam away from the roof at a desired location. The portable beam support 25 is then placed underneath the beam 1 at a beam pin hole 12 adjacent to the set of beam lifters 2 and affixed to the beam 1 with a pin that traverses through the beam pin hole 12 and a pin hole centrally located on the portable beam support 25. With the portable beam support 25 supporting the weight of the beam 1, the adjacent set of beam lifters 2 can be retracted so that work can be done on the roof underneath the adjacent set of beam lifters 2. In the preferred embodiment the portable beam support 25 comprises a pair of legs 26 and a beam bracket 27 attached atop the legs 26. A pin hole centrally traverses through the bracket in order to attach the portable beam support 25 to the beam 1. Referring to FIG. 4, in the preferred embodiment of the present invention, each of the plurality of beam lifters 2 is connected to one of the step rods 11 and is positioned opposite the beam 1 along the one of the step rods 11 at the outermost lateral end of the one of the step rods 11. Each of the beam lifters 2 comprises a threaded sheath 21, a threaded stud 22, a turn handle 23, and a lifter foot 24. The threaded sheath 21 is the component of the beam 1 lifter that is connected to the one of the step rods 11. The threaded stud 22 is threadedly engaged within the threaded sheath 21. The turn handle 23 is connected to an end of the threaded stud 22. The lifter foot 24 and the turn handle 23 are positioned opposite each other along the threaded stud 22, and the threaded sheath 21 is positioned between the turn handle 23 and the lifter foot 24. The lifter foot 24 fits over the end of the beam 1 lifter and makes direct contact with the surface of the roof. The lifter foot 24 is comprised of a material that will not damage the roof when in direct contact with it. Some examples of materials that may work well as the lifter foot 24 include, but are not limited to plastic and rubber. The lifter foot 24 may also help to increase friction between the beam 1 lifter and the roof, helping to prevent slipping which could be dangerous to the user.

In the preferred embodiment of the present invention each of the plurality of beam lifters 2 is a basic screwing mechanism which provides the user with the capability of lifting the beam 1 away from the roof being worked on. This is useful for various roofing situations such as installing shingles underneath the beam 1. In the preferred embodiment of the present invention seen in FIG. 1, there are fewer beam lifters 2 than step rods 11. For example, in the preferred embodiment there are seven step rods 11 and three beam lifters 2, with one beam 1 lifter being connected to the first step rod 111 one beam 1 lifter being connected to the last step rod 112, and one beam 1 lifter being connected to the fourth step rod midway between the first step rod 111 and the last step rod 112. However in alternate embodiments the beam lifters 2 may be equal in number and connected to each of the step rods 11, or the beam lifters 2 may comprise another arrangement. Furthermore, it is possible that other forms of beam lifters 2 may exist in which different methods are used to lift the beam 1 off of the roof. For example, the beam 1 lifter may use a rack and pinion as opposed to threads, or a lever system. Any type or embodiment of beam 1 lifter may be used so long as the beam 1 is lifted off of the roof and the beam 1 lifter can be pulled away from the roof such that the beam 1 lifter is not contacting the roof.

The roof anchor hook 3 functions to secure the present invention in place atop a roof while in use. The purpose of the roof anchor hook 3 is to protrude over the ridge and onto the other side of the roof. This allows the present invention to transmit the weight of the present invention and the weight of the user climbing on the present invention into the ridge of the roof. This is ideal as the ridge of the roof is very strong and at an ideal position to make use of gravitational forces to secure the present invention to the roof without the need for any straps or fasteners. In the preferred embodiment the hook portion 31 comprises a ninety degree bend in a circular cross section structural element. The bend does not necessarily need to be ninety degrees, and the cross section of the anchor hook does not necessarily need to be circular. The most important thing that must be maintained in the roof anchor hook 3 is strength and rigidity such that the anchor hook can easily hold the weight of both the present invention and the user without failing. Details such as bend angle and materials used may vary in the manufacturing of the present invention. The roof anchor hook 3 is present to distribute to load of the present invention and any users across a surface of the roof large enough such that the pressure the roof is subjected to does not damage the roof. Furthermore having a large area of contact between the present invention and the roof helps to increase friction and prevent slippage as well as helping to prevent tipping of the present invention when the user climbs up the beam 1.

Figure 5:
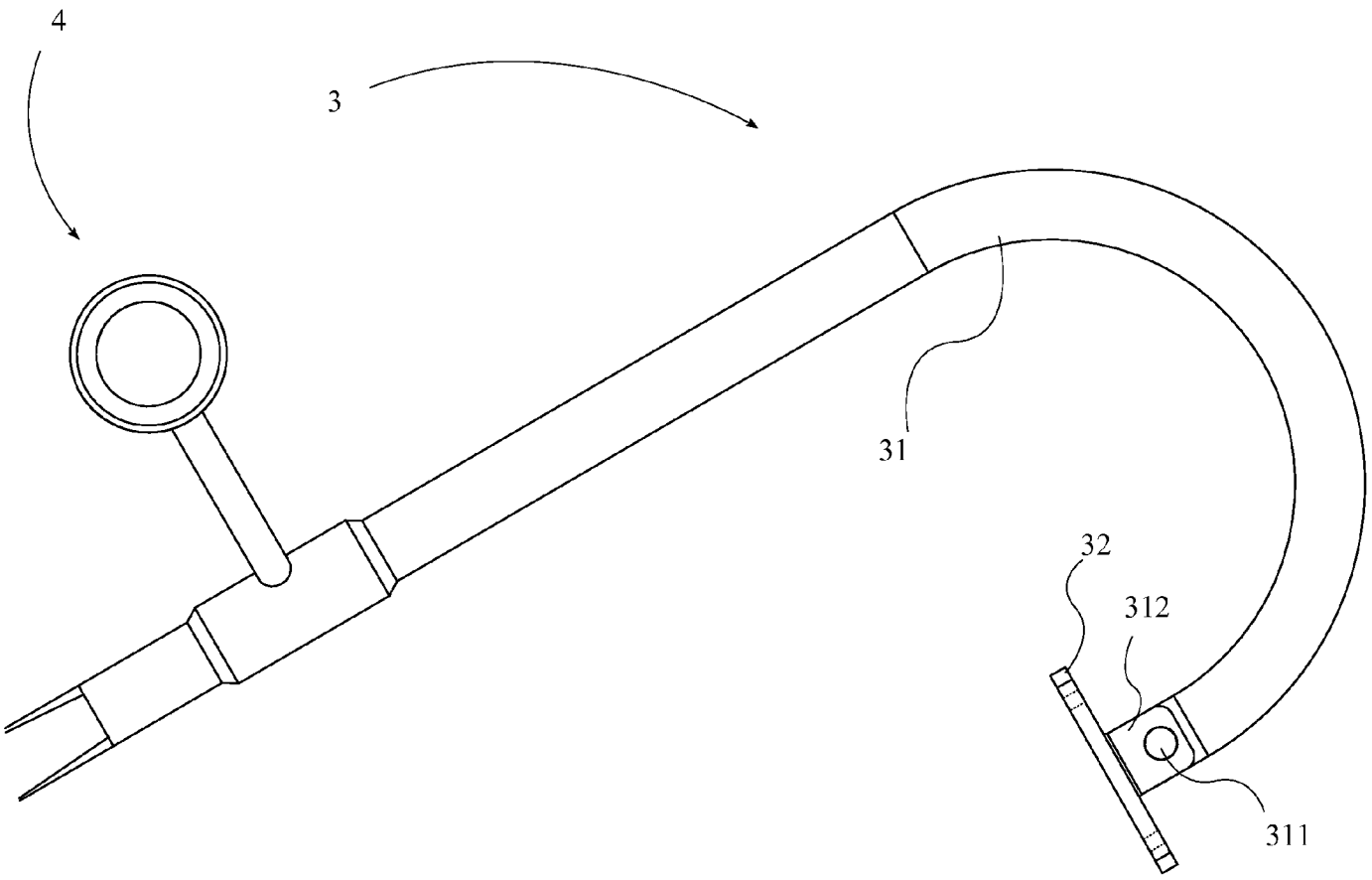
FIG. 5 is a side view of the wheel assembly and the roof anchor hook.

As seen in FIGS. 1 and 5, the roof anchor hook 3 is coaxially connected to the beam 1 adjacent to the wheel assembly 4 opposite the last step rod 112, wherein the wheel assembly 4 is positioned between the last step rod 112 and the roof anchor hook 3. The roof anchor hook 3 comprises a hook portion 31 and an anchor plate 32. The hook portion 31 is connected to the beam 1, extending away the beam 1 and curving around, forming a hook shape. The anchor plate 32 is a large rectangular plate that contacts the surface of the roof. The anchor plate 32 is rotatably connected to the hook portion 31 opposite the beam 1 along the hook portion 31. In the preferred embodiment, the hook portion 31 comprises a roof anchor pin hole 311 which traverses through the hook portion 31 and a anchor plate mount 312 of the anchor plate 32 and allows the roof anchor to be pivotally connected to the roof anchor hook 3. The anchor plate 32 should be flush with the roof for maximum effectiveness; the pivot mount ensures that this is possible on a variety of different roof angles. Additionally, in the preferred embodiment of the present invention the anchor plate 32 comprises a plurality of pre-drilled holes. The pre-drilled holes provide means to fasten the anchor plate 32 to the roof in order to facilitate additional stabilization for the present invention atop the roof.

Figure 6:
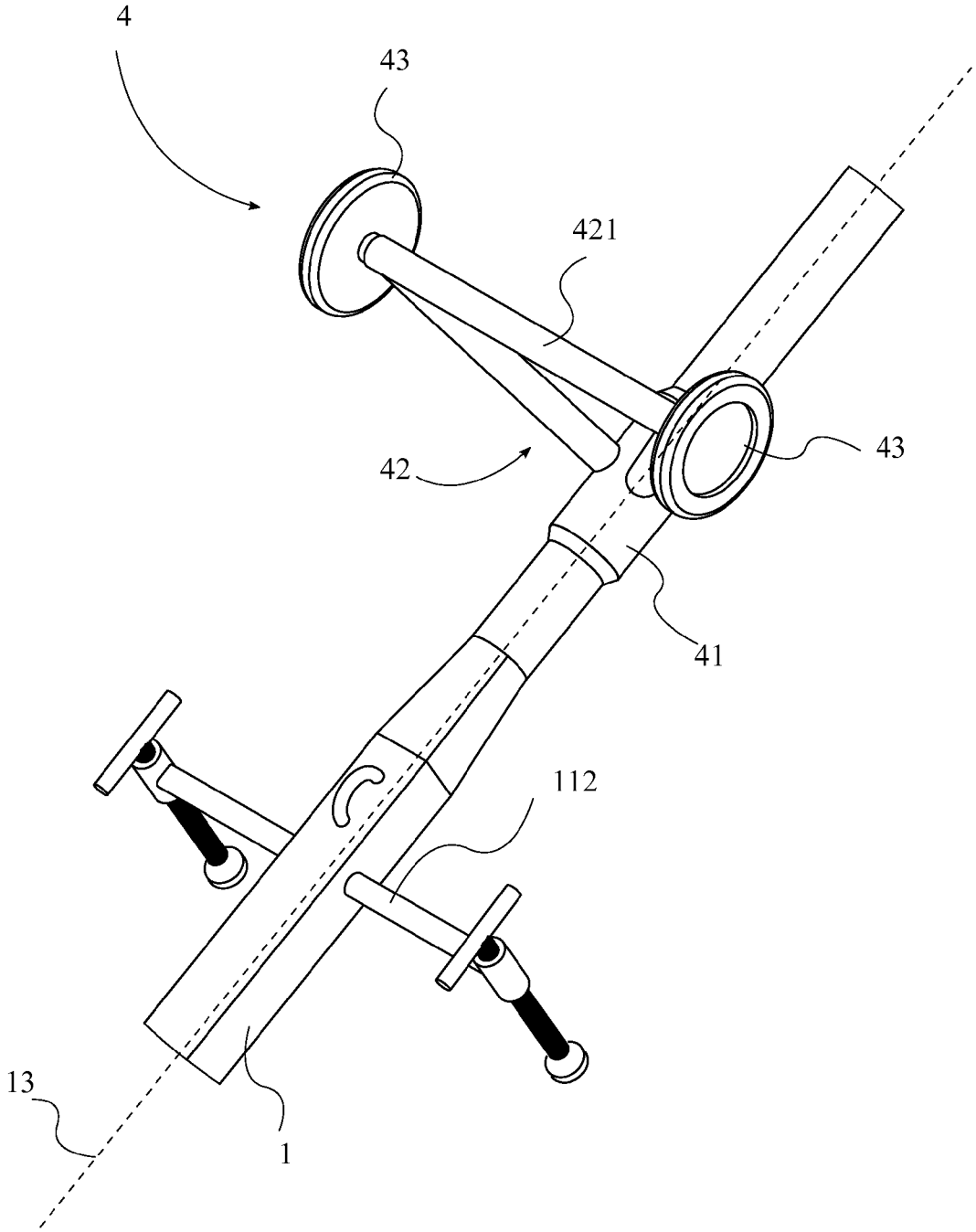
FIG. 6 is a perspective view of the wheel assembly, the last step rod and a pair of beam lifters.

Referring to FIGS. 2 and 6, the wheel assembly 4 is rotatably connected to the beam 1 adjacent to the last step rod 112. The wheel assembly 4 comprises a sleeve 41, a frame 42, and a plurality of wheels 43. The beam 1 further comprises a wheel assembly attachment portion 17. The wheel assembly attachment portion 17 is cylindrical, and is positioned between the last step rod 112 and the roof anchor hook 3. The sleeve 41 encircles the wheel assembly attachment portion 17 and is able to rotate about the wheel assembly attachment portion 17 about the central axis 13 of the beam 1. Preferably, the sleeve 41 is held in place at the wheel assembly attachment portion 17 by a pair of flanges 18 on the beam 1 axially enclosing the wheel assembly attachment portion 17. The frame 42 is connected to the sleeve 41, and each of the plurality of wheels 43 are rotatably connected to the frame 42 opposite the sleeve 41, wherein the frame 42 separates the plurality of wheels 43 from the sleeve 41 and thereby from the beam 1. It is important that the frame 42 protrude out far enough from the beam 1 such that the beam 1 may be rotated while the wheel assembly 4 is resting on the surface of the roof. In the preferred embodiment, the frame 42 comprises an axle 421, and each the plurality of wheels 43 is rotatably connected to the axle 421 opposite each other. However it is contemplated that in alternate embodiments alternate frame 42 structures may be utilized which do not comprise an axle 421.

The wheel assembly 4 allows the user to easily install the present invention in place on a roof. First, the user lifts the beam 1 onto the roof so that the wheels 43 of the wheel assembly 4 contact the surface of the roof, with the beam 1 being rotated so that the roof anchor hook 3 curves away from the roof, instead of toward the roof as when the present invention is installed for use. Then, the beam 1 is slid up the roof until the roof anchor hook 3 is past the ridge of the roof. Once the roof anchor hook 3 is at this point, the beam 1 is rotated such that it is right side up and the anchor hook protrudes down over the ridge where it is in a position to prevent the present invention form falling off the roof. The roof anchor makes contact with the roof and the present invention is secure and ready to be used. The wheels 43 greatly ease the process of placing the present invention on the roof.

Figure 7:
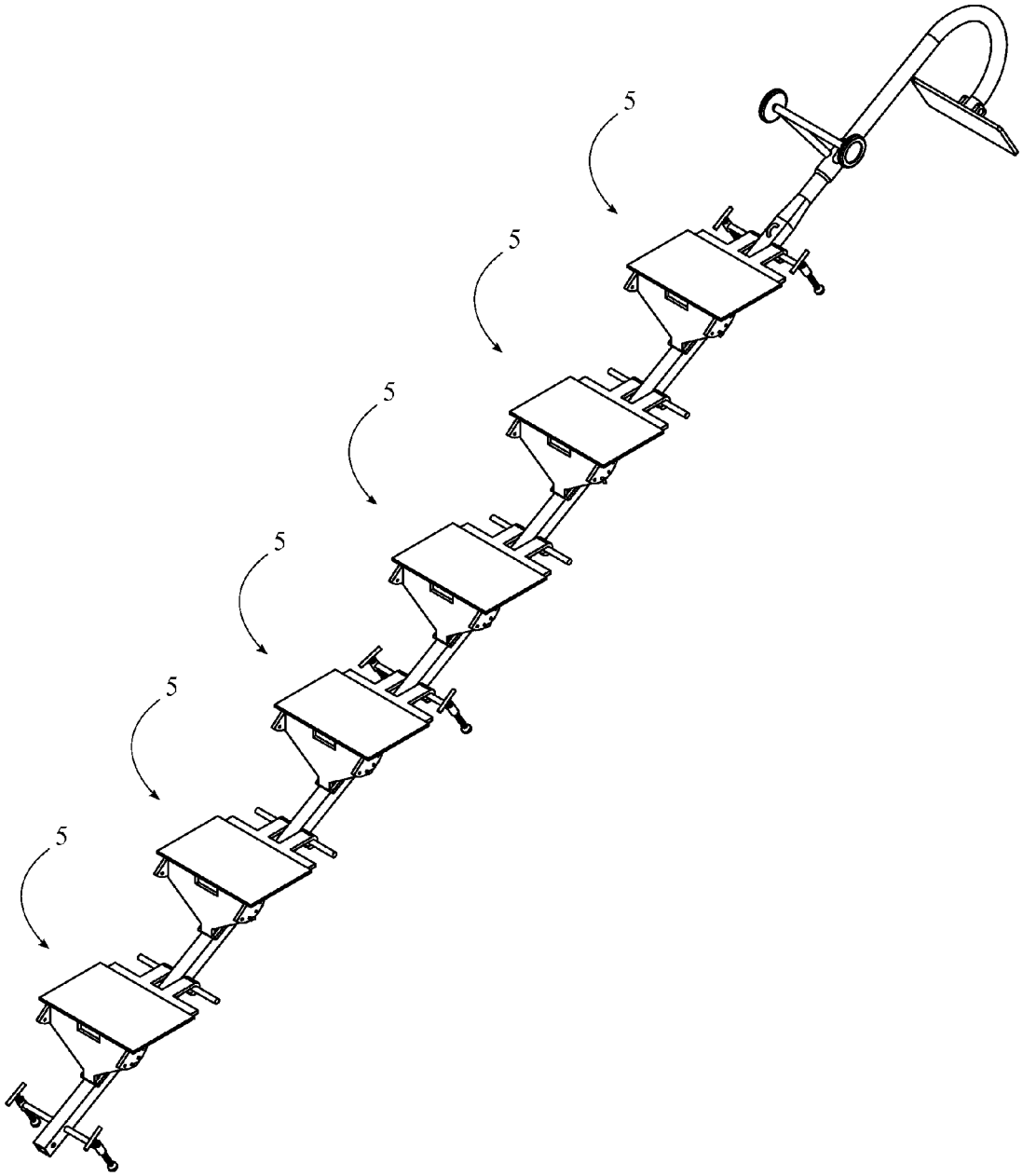
FIG. 7 is a perspective view of the present invention with a platform assembly attached to every step rod.

The present invention as described above is fully functional as a ladder without needed additional components, however further components are introduced to provide additional functions that can be useful when performing roofing tasks such as applying shingles. The platform assembly 5 of the present invention is designed such that the user may sit on the present invention and perform roofing tasks from that position, as well as store tools or materials relevant to the job being done. The platform assembly 5 is removably attached to one of the plurality of step rods 11. The platform assembly 5 is a modular component, and can be attached to and removed from any of the plurality of step rods 11 as desired for customization. Additionally, multiple platform assemblies may be utilized, as shown in FIG. 7. In one embodiment, only one platform assembly 5 is utilized. In another embodiment, a platform assembly 5 is utilized on every step rod. This latter case is fairly impractical as it would make the present invention heavy and clumsy to maneuver into plate on the roof, however it is still possible and shown and described in order to demonstrate the modularity of the platform assembly 5.

Figure 8:
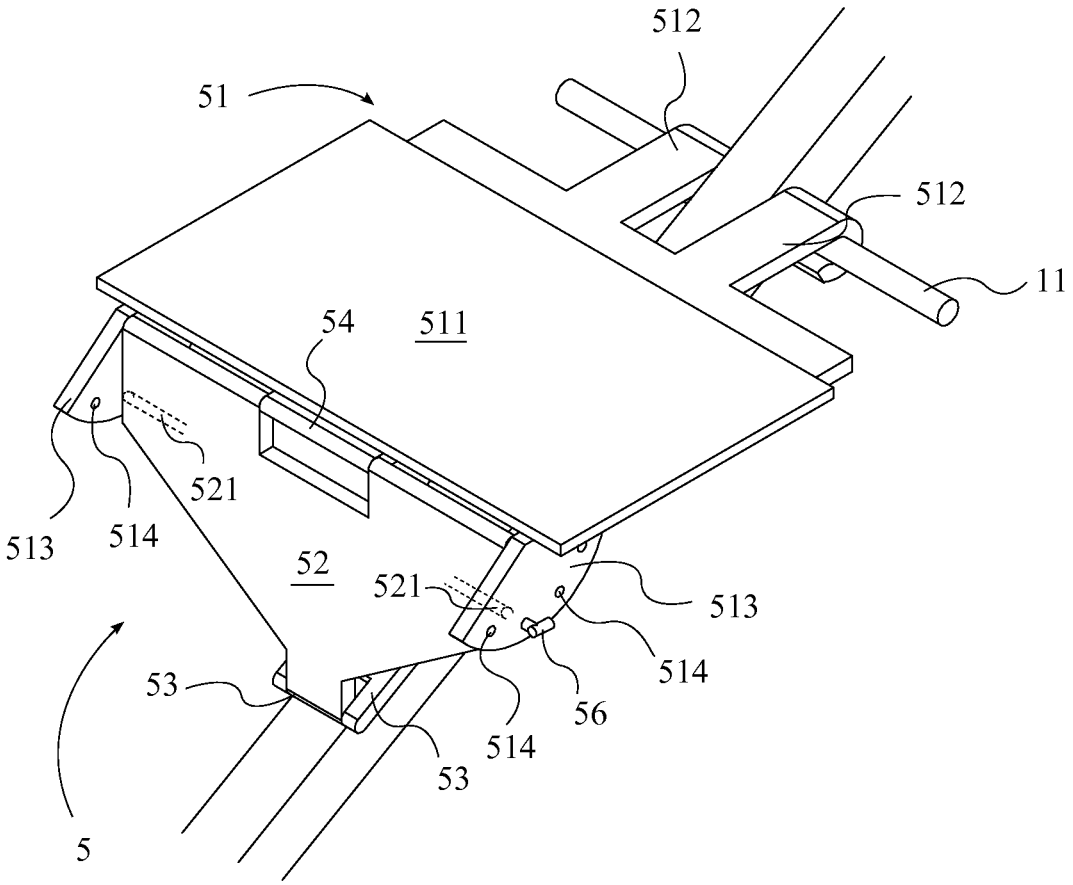
FIG. 8 is a perspective detail view of the platform assembly.
Figure 9:
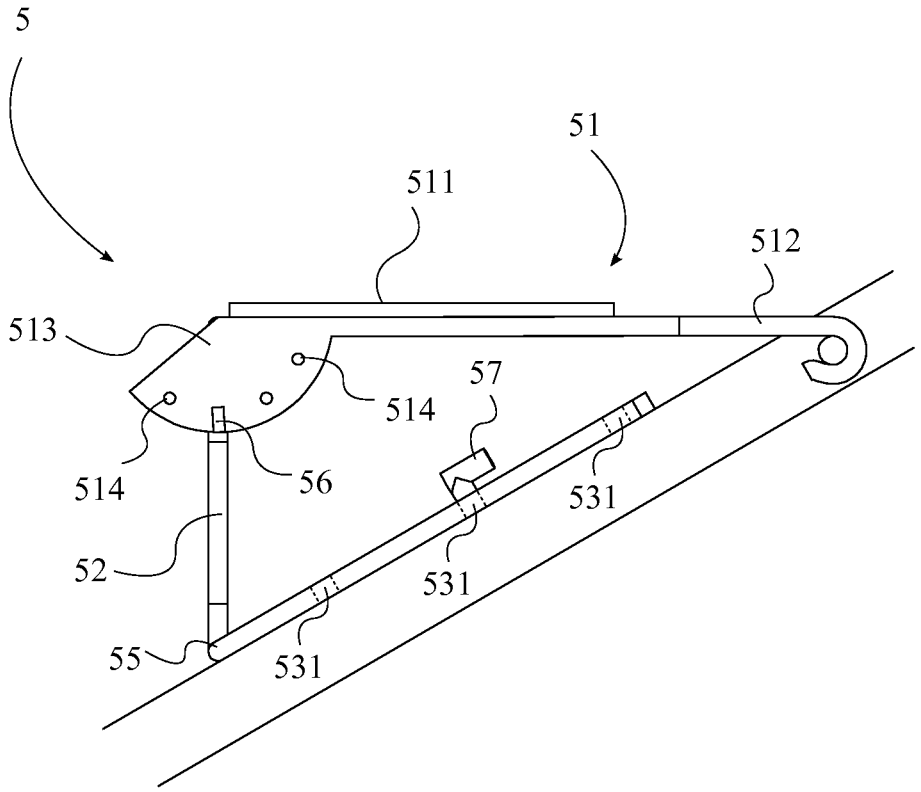
FIG. 9 is a side detail view thereof.

Referring to FIGS. 8-9, the platform assembly 5 comprises a seat plate 51, a front plate 52, and a beam attachment plate 53. The seat plate 51 is hingedly connected to the front plate 52 by a first hinge connection 54, and the beam attachment plate 53 is hingedly connected to the front plate 52 opposite the seat plate 51 by a second hinge connection 55. In the preferred embodiment of the present invention, the front plate 52 is selectively constrained to a desired angle relative to the seat plate 51, and the beam attachment plate 53 is selectively constrained against the top side of the beam 1 in a desired position along the beam 1.

In the preferred embodiment of the present invention, the seat plate 51 comprises a seat body 511, a pair of attachment hooks 512 and a pair of pin plates 513, and is symmetric about the symmetry reference plane 6. The seat body 511 is located on the top of the plate and provides a significant surface area on which the user may sit, step, or even stand. The seat body 511 may be textured such that slippage between the seat and the user is minimized. The pair of attachment hooks 512 is connected to the seat body 511 and allows the seat plate 51 to be attached to any of the plurality of step rods 11 by hooking the pair of attachment hooks 512 onto one of the plurality of step rods 11. The pair of attachment hooks 512 allows the plate to pivot relative to the beam 1 which is important to allow the seat to be adjusted to adapt to the angle of the roof.

Figure 10:
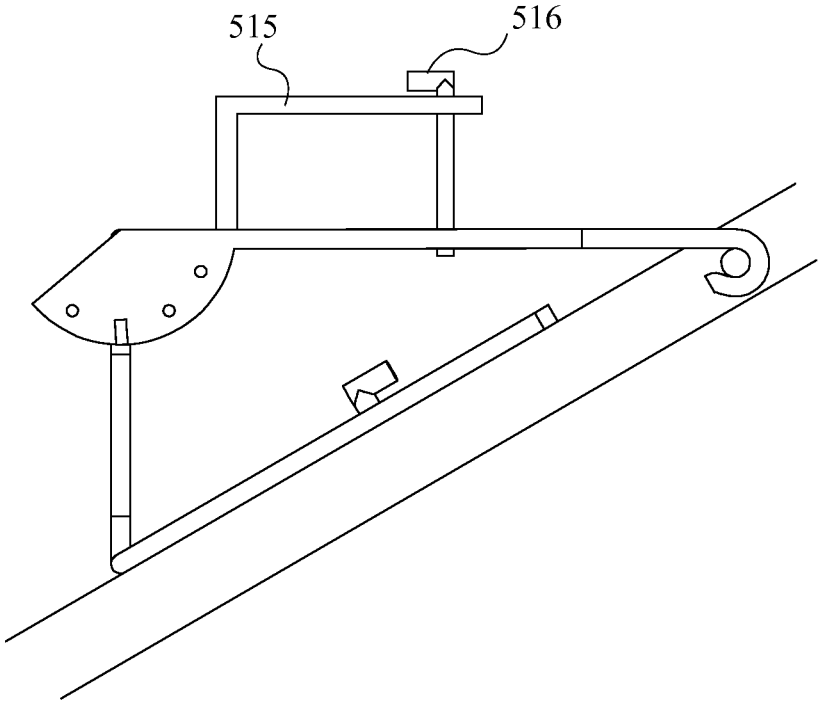
FIG. 10 is a side detail view of the alternate seat plate embodiment.

In an alternative embodiment shown in FIG. 10, the seat plate 51 additionally comprises components to allow a plank to be secured to the seat. This serves to allow the user to implement two of the present invention in conjunction on one roof alongside each other with a plank traversing the space between them, thus offering significant surface area on which workers may sit, stand, walk or place tools and supplies. This alternative embodiment of the seat surface may be used with any desired dimension of plank. The alternative embodiment of the seat surface comprises an L bracket 515 that protrudes up from the seat body 511 and a bracket pin 516 that traverses vertically down through the L bracket 515 and into the plate. The plank is slid under the L bracket 515 and the bracket pin 516 is used to secure the plank.

The first hinge connection 54 is positioned opposite the pair of attachment hooks 512 along the seat body 511. The pair of pin plates 513 are connected to the seat body 511, and are positioned opposite the pair of attachment hooks 512 along the seat body 511. The pair of pin plates 513 are oriented parallel to a symmetry reference plane 6, wherein the pair of pin plates 513 are oriented perpendicular to the seat body 511. The pair of pin plates 513 is positioned symmetrically about the symmetry reference plane 6. In the preferred embodiment of the present invention the first hinge connection 54 is positioned between the pair of pin plates 513 symmetrically about the symmetry reference plane 6. Each of the pair of pin plates 513 comprises a plurality of seat plate 51 pin holes 514 angularly distributed on the pin plate along a circular arc, wherein a center of the circular are is aligned along a hinge axis for the first hinge connection 54. The pair of pin plates 513 allows the front plate 52 to be secured at several different angles as is necessary to allow adjustment of the angle of the seat plate 51.

The front plate 52 comprises a pair of front plate pin holes 521. The pair of front plate pin holes 521 is oriented perpendicular to the symmetry reference plane 6, traverse into the front plate 52 and are positioned opposite each other on opposing lateral faces 16 on the front plate 52. Each of the pair of front plate pin holes 521 is selectively aligned with one of the plurality of seat plate 51 pin holes 514 from the pair of pin plates 513 by rotating the front plate 52 about the first hinge connection 54. A pair of front plate pins 56 is removably inserted through one of the plurality of seat plate 51 pin holes 514 and the pair of front plate pin holes 521, wherein the front plate 52 is angularly fixed relative to the seat plate 51 by inserting the pair of front plate pins 56 through one of the plurality of seat plate 51 pin holes 514 and the pair of front plate pin holes 521.

The beam attachment plate 53 is of a generally rectangular shape and is flush with the topside face 14 of the beam 1. The beam attachment plate 53 comprises a plurality of beam 1 attachment pin 57 holes 531 linearly spaced apart from each other along the beam attachment plate 53. A beam 1 attachment pin 57 is removably inserted through one of the plurality of beam 1 attachment pin 57 holes 531 and one of the beam pin holes 12, wherein the beam attachment plate 53 is affixed to the beam 1 by inserting the beam 1 attachment pin 57 through one of the plurality of beam 1 attachment pin 57 holes 531 and one of the beam pin holes 12. When the seat is adjusted, the seat bottom is slid along the beam 1 until one of the plurality of beam 1 attachment pin 57 holes 531 matches up with one of the plurality of beam pin holes 12. As such, every one of the plurality of beam 1 attachment pin 57 holes 531 corresponds to a specific angle of the plate and a specific angle of the seat front relative to the plate. When the beam attachment plate 53 is pinned in place against the beam 1, and the front plate 52 is pinned in place against the seat plate 51, the platform assembly 5 is secure and ready to be used.

Figure 12:
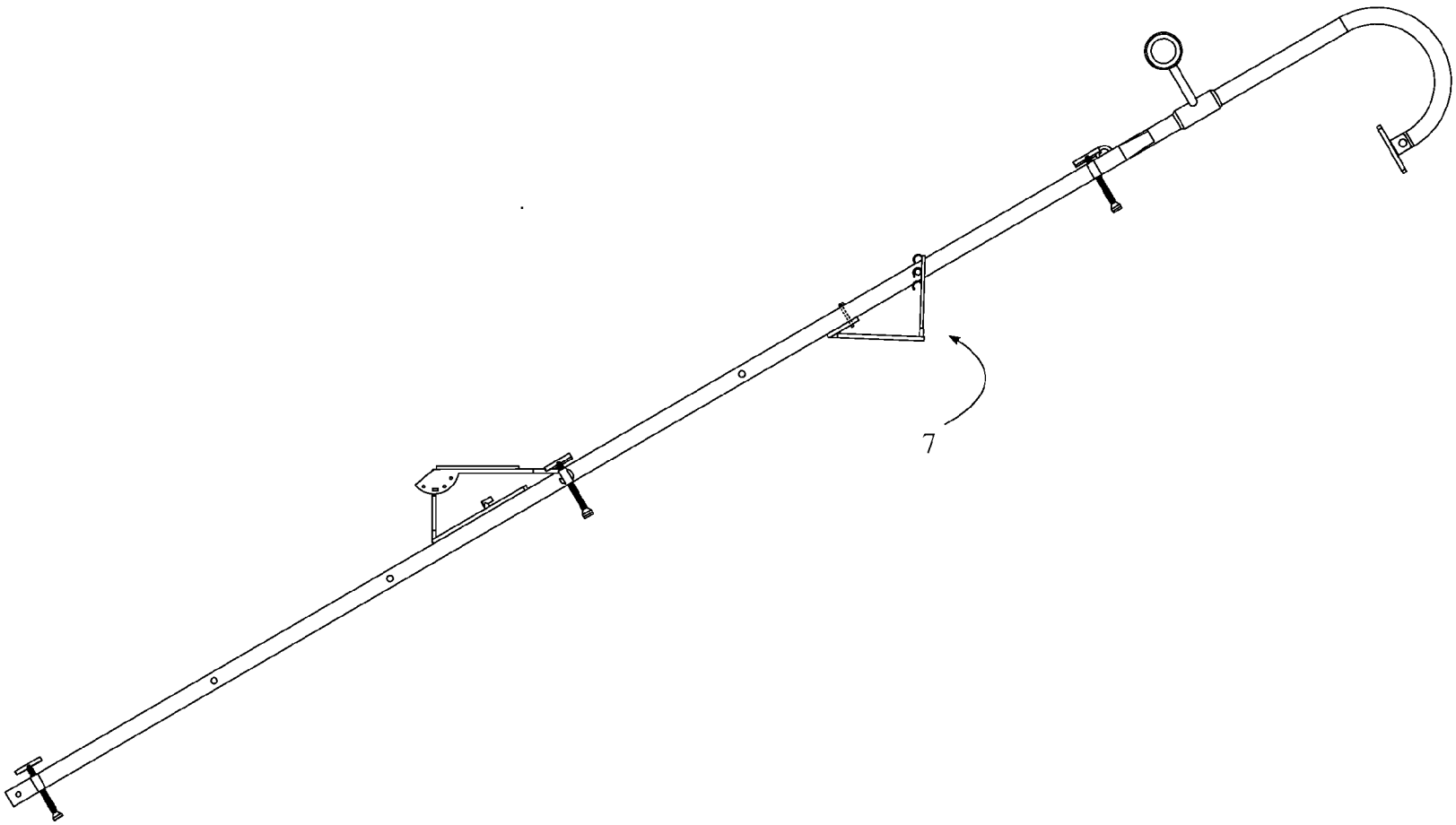
FIG. 12 is a view of the present invention with a platform assembly and a lower bracket.
Figure 13:
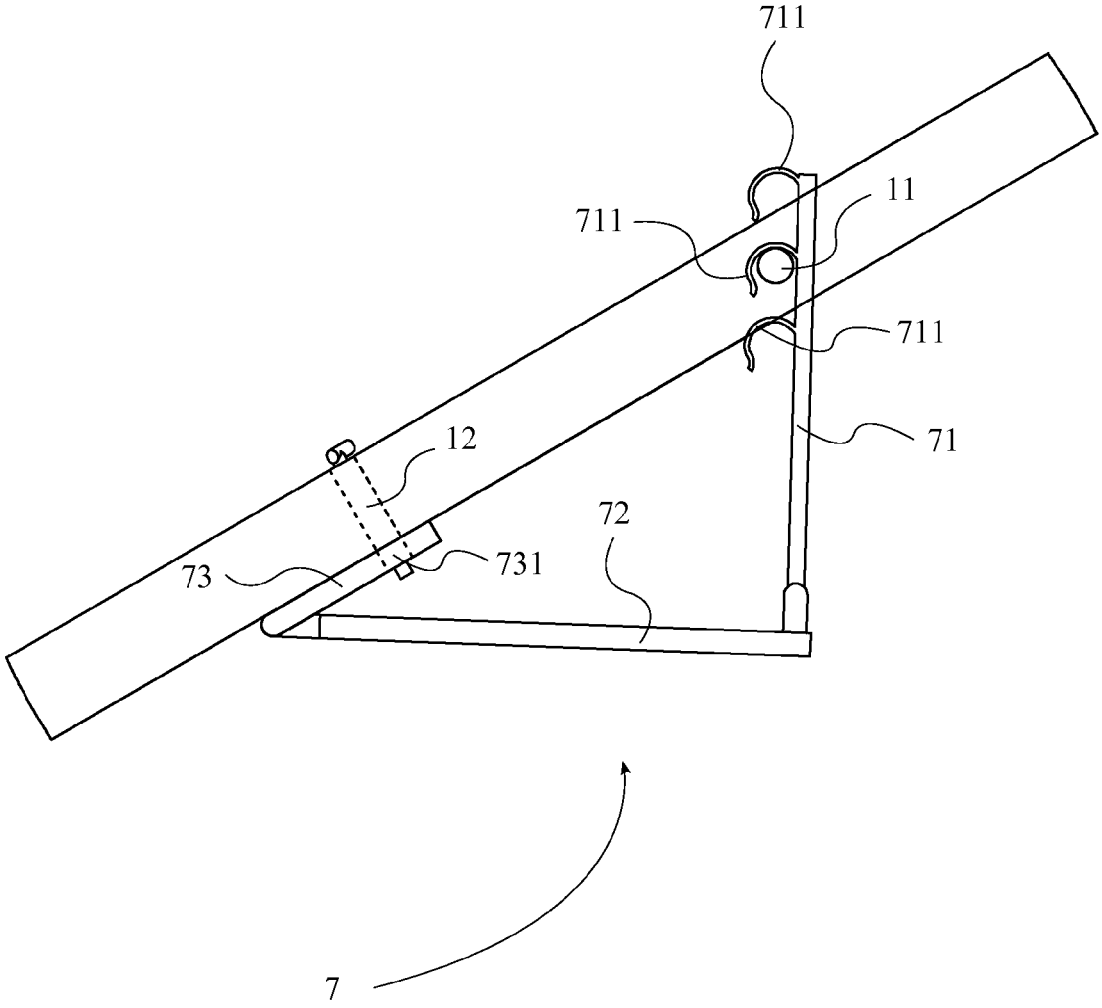
FIG. 13 is a side detail view of the lower bracket.
Figure 14:
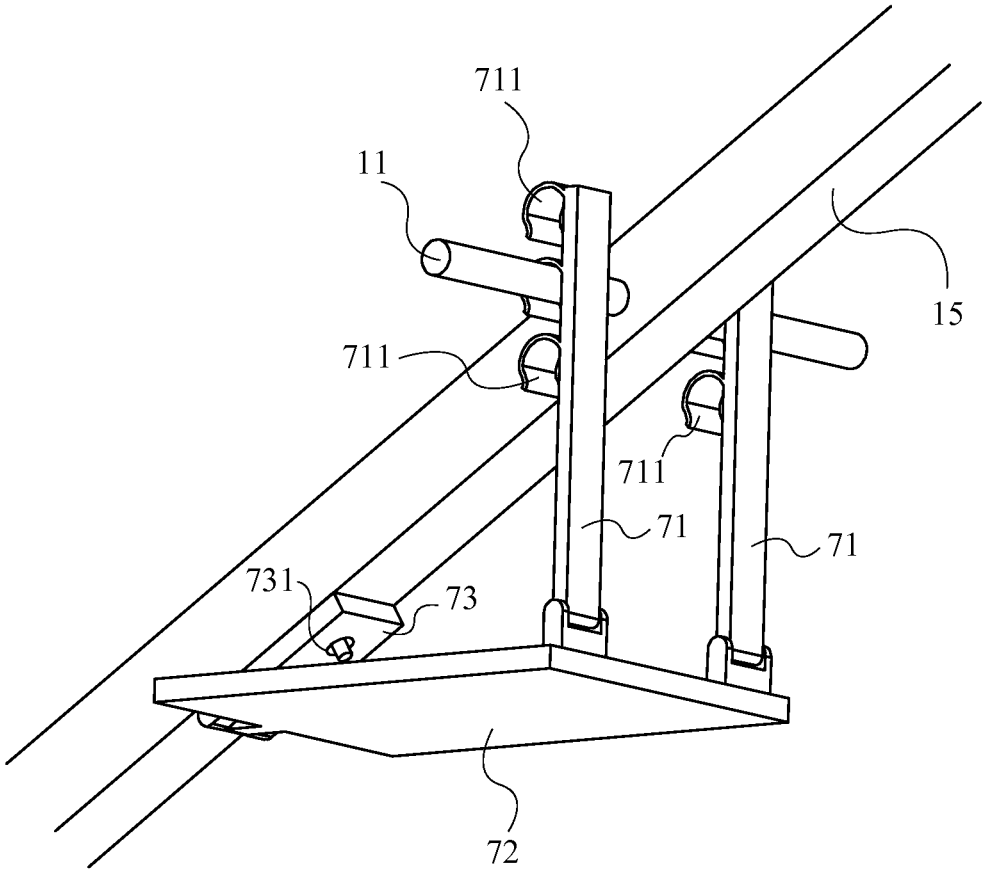
FIG. 14 is a lowered perspective detail view of the lower bracket.

Referring to FIGS. 12-14, an additional modular attachment similar to the platform assembly 5 is a lower bracket 7. The lower bracket 7 comprises a pair of hook arms 71, a support plate 72, and a lower attachment plate 73. Each of the pair of hook arms 71 comprises a plurality of hooks 711 which are positioned linearly adjacent to each other along the pair of hook arms 71. The lower attachment plate 73 is hingedly connected to the support plate 72. The pair of hook arms 71 is hingedly connected to the support plate 72 opposite the lower beam attachment plate 53.

The lower attachment plate 73 comprises lower attachment plate pin hole 731. The lower attachment is removably attached to the underside face 15 of the beam 1 by inserting a pin through one of the plurality of beam pin holes 12 and through the lower attachment plate pin hole 731. One of the plurality of hooks 711 is removably attached to one of the step rods 11, wherein the orientation for the support plate 72 is determined by which of the plurality of hooks 711 is attached to the one of the step rods 11. The one of the step rods 11 is positioned adjacent to the one of the plurality of beam pin holes 12 along the beam 1.

Figure 11:
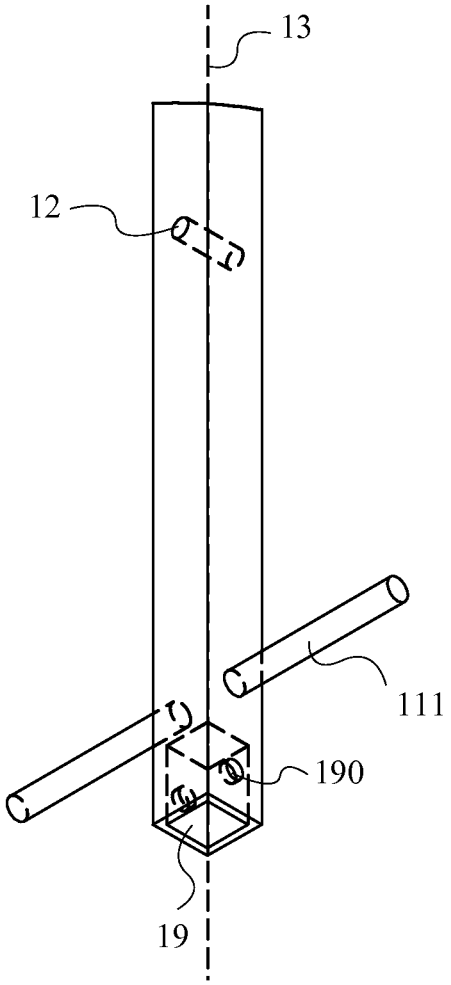
FIG. 11 is a detail perspective view of the extension slot.

In the preferred embodiment of the present invention, the beam 1 further comprises an extension slot 19 as shown in FIG. 11. The extension slot 19 is a hollow space within the beam 1 oriented parallel to the central axis 13 of the beam 1. The extension slot 19 axially and centrally traverses into the beam 1 adjacent to the first step rod 111. The extension slot 19 allows the length of the present invention to be extended by inserting a beam 1 extender or an extender pole into the extension slot 19. The beam 1 extender takes into account the fact that the length of the roof from ridge to gutter may vary drastically from house to house and in some cases it may be necessary to lengthen the beam 1 of the present invention such that a greater amount of roof is covered by the present invention. The beam 1 extender accomplishes this by providing a component which is nearly identical to the beam 1 in every way with the exception of the fact that at the top of the extension beam 1 there is no anchor hook and there is no wheel assembly 4. Instead, there is a coupler which allows the beam 1 extender to be connected to the beam 1 via the extension slot 19. The extension beam 1 also has an extension slot 19 of its own, allowing multiple extension beam is to be chained together to the length that is needed by the user. An extension pole may also be utilized, which allows the user to push the present invention up into place on a roof while standing on the ground. The extension slot 19 comprises an extension pin hole 190, through which a pin may be inserted in order to keep the beam 1 extender or extender pole from accidentally becoming removed from the beam 1.

In the preferred embodiment of the present invention, a safety hook 8 is positioned on the topside face 14 of the beam 1 adjacent to the last step rod 112, as shown in FIGS. 1-2. The purpose of the safety hook 8 is to allow the user to attach a line to the present invention such that they are stopped from falling off the roof if they fall off of the present invention. The safety hook 8 comprises a loop of material that protrudes up from the surface of beam 1 and allows the user to run a rope through or attach a clip to the safety hook 8. Thus, it is possible for the user to secure themselves to the present invention via a safety line and not worry about falling from the roof if they fall off of the present invention. The exact positioning of the safety hook 8 along the beam 1 may vary and there may be more than one safety hook 8 present on the beam 1 if deemed necessary by the manufacturer. In an alternative embodiment, the safety hook 8 is positioned on the hook portion 31, directly adjacent to the pivot plate mount 312, or a second safety hook 8 is positioned in the aforementioned location in addition to the safety hook 8 adjacent to the last step rod 112. In general, higher on the beam 1 (further from the lower end or the first step rod 111) is better. An additional safety hook located on the hook portion 31 adjacent to the pivot plate mount 312 may be used for additional stability in using the present invention by tying a line to the additional safety hook and to a tree or another anchoring object on the opposite side of the building being worked on from the position of the present invention on the roof.

Figure 15:
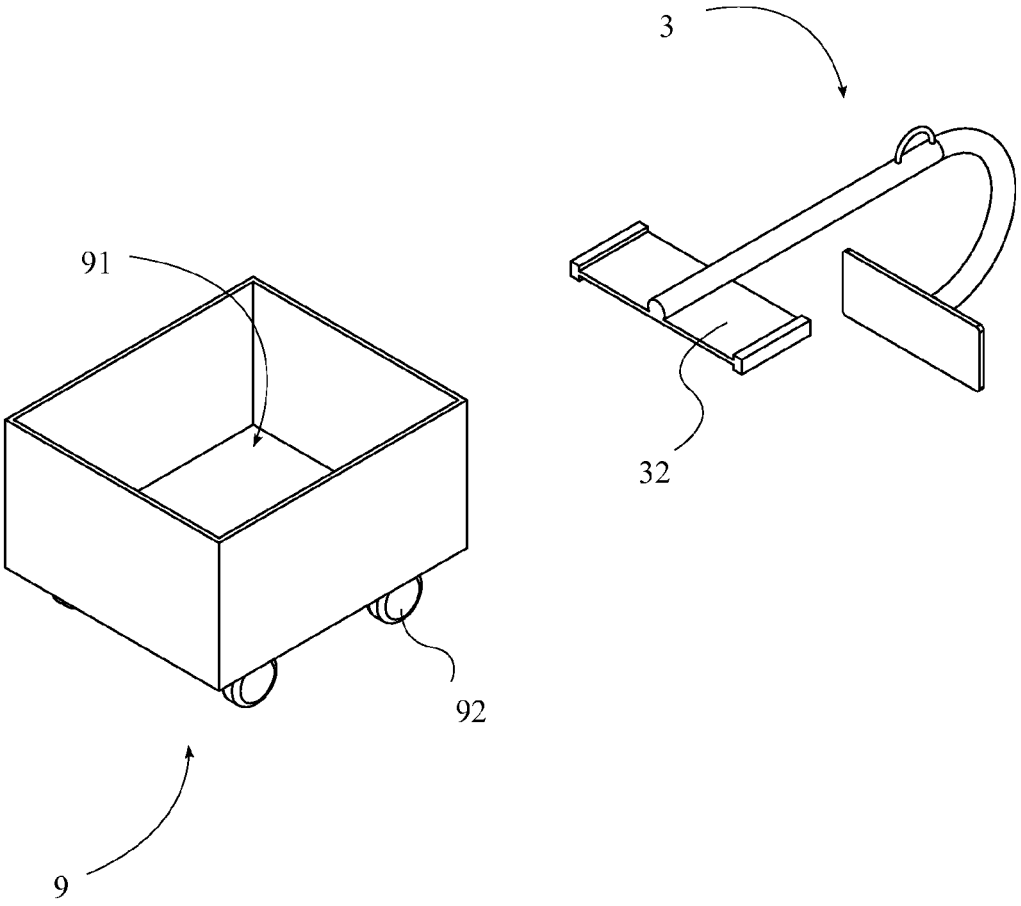
FIG. 15 is a perspective view of the roof anchor hook in use with a material dolly.
Figure 16:
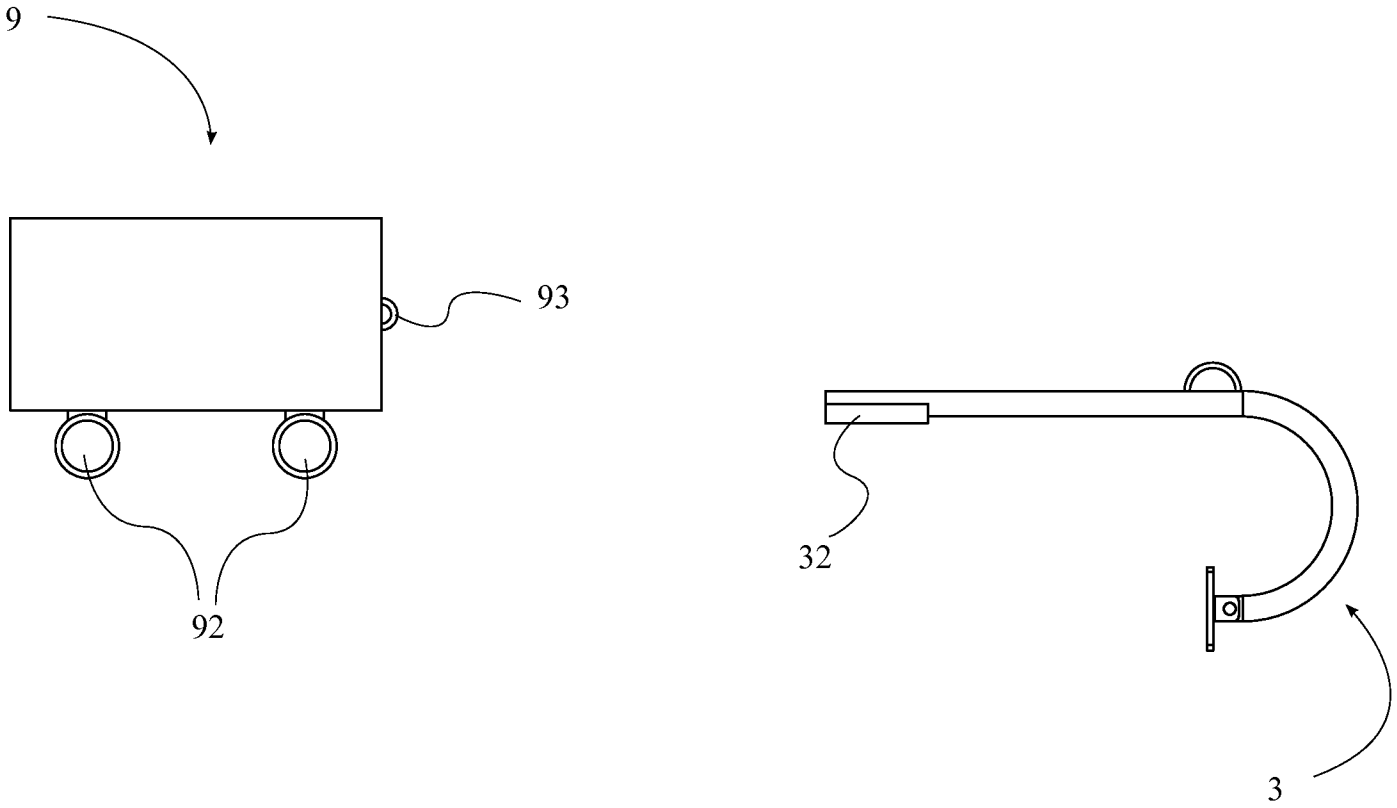
FIG. 16 is a side view of the roof anchor hook in use with a material dolly.

Referring to FIGS. 15-16, it is also contemplated that an additional embodiment of the present invention exists in which the roof anchor hook 3 concept is utilized to create an anchor point for a rope block or pulley system that can be used to transport materials up the roof quickly and easily. The alternative embodiment comprises the roof anchor hook 3, and a material dolly 9. The roof anchor hook 3 is very similar to that of the preferred embodiment of the present invention, however it is not connected to a beam 1, and further comprises a stabilization plate opposite the anchor plate 32 along the roof anchor hook 3. The stabilization plate prevents the roof anchor hook 3 from tipping over, sliding, or otherwise becoming improperly placed on the ridge of the roof. The stabilization plate is necessary in the absence of the beam 1 as is the case in the alternative embodiment. The roof anchor hook 3 also comprises a pulley hook which allows a pulley or a rope block, or a rope to be attached to the roof anchor hook 3 which is subsequently attached to the material dolly 9. The material dolly 9 comprises a cargo volume 91, a wheel system 92, and a pulley loop 93. The material dolly 9 is connected to the roof anchor hook 3 via a rope. The resulting system allows a worker to load materials into the material dolly 9 and then pull the rope such that the material dolly 9 is pulled up the roof. There may be other uses for the alternative embodiment such as for safety anchoring purposes if only the roof anchor hook 3 is used.

Although the invention has been explained in relation to its preferred embodiment, it is to be understood that many other possible modifications and variations can be made without departing from the spirit and scope of the invention as hereinafter claimed.

What is claimed is:

1. A roofing ladder with a modular angularly adjustable platform comprises:

a beam comprising a plurality of step rods, a plurality of pin holes, and a central axis;

a roof anchor hook;

a wheel assembly;

a platform assembly;

a plurality of beam lifters;

the plurality of step rods being connected to the beam;

the plurality of step rods being spaced apart from each other along the beam;

a first step rod from the plurality of step rods and a last step rod from the plurality of step rods being positioned opposite each other along the beam;

the plurality of beam pin holes being spaced apart from each other along the beam;

the wheel assembly being rotatably connected to the beam adjacent to the last step rod;

the platform assembly being removably attached to one of the plurality of step rods;

the roof anchor hook being connected to the beam adjacent to the wheel assembly;

the wheel assembly comprises a sleeve, a frame, and a plurality of wheels;

the beam further comprises a wheel assembly attachment portion;

the wheel assembly attachment portion being cylindrical;

the wheel assembly attachment portion being positioned between the last step rod and the roof anchor hook;

the sleeve encircling the wheel assembly attachment portion, wherein the sleeve is able to rotate about the wheel assembly attachment portion;

the frame being connected to the sleeve; and the plurality of wheels being rotatably connected to the frame opposite the sleeve, wherein the frame separates the plurality of wheels from the sleeve.

2. The roofing ladder with a modular angularly adjustable platform as claimed in claim 1 comprises:

the beam, the roof anchor hook, the platform assembly, and the plurality of beam lifters being symmetric about a symmetry reference plane; and the symmetry reference plane containing the central axis.

3. The roofing ladder with a modular angularly adjustable platform as claimed in claim 2 comprises:

the symmetry reference plane being oriented perpendicular to each of the plurality of step rods.

4. The roofing ladder with a modular angularly adjustable platform as claimed in claim 1 comprises:

the plurality of step rods and the plurality of beam pin holes being alternatingly arranged along the beam.

5. The roofing ladder with a modular angularly adjustable platform as claimed in claim 1 comprises:

the roof anchor hook being coaxially connected to the beam adjacent to the wheel assembly opposite the last step rod, wherein the wheel assembly is positioned between the last step rod and the roof anchor hook;

the roof anchor hook comprises a hook portion and an anchor plate;

the hook portion being connected to the beam; and the anchor plate being rotatably connected to the hook portion opposite the beam along the hook portion.

6. The roofing ladder with a modular angularly adjustable platform as claimed in claim 1 comprises:

the beam further comprises an extension slot; and the extension slot axially and centrally traversing into the beam adjacent to the first step rod, wherein the extension slot is a hollow space within the beam oriented parallel to the central axis of the beam.

7. The roofing ladder with a modular angularly adjustable platform as claimed in claim 1 comprises:

each of the plurality of step rods being perpendicularly connected to the beam, wherein each of the plurality of step rods is oriented perpendicular to a symmetry reference plane; and each of the plurality of beam pin holes being oriented perpendicular to the central axis of the beam and the plurality of step rods, wherein each of the plurality of beam pin holes is oriented parallel to the symmetry reference plane.

8. The roofing ladder with a modular angularly adjustable platform as claimed in claim 1 comprises:

each of the plurality of beam lifters being connected to one of the step rods.

9. The roofing ladder with a modular angularly adjustable platform as claimed in claim 8 comprises:

each of the plurality of beam lifters being positioned opposite the beam along the one of the step rods.

10. The roofing ladder with a modular angularly adjustable platform as claimed in claim 1 comprises:

each of the plurality of beam lifters comprises a threaded sheath, a threaded stud, and a turn handle;

the threaded sheath being connected to one of the plurality of step rods;

the threaded stud being threadedly engaged within the threaded sheath; and the turn handle being connected to the threaded stud.

11. The roofing ladder with a modular angularly adjustable platform as claimed in claim 10 comprises:

each of the plurality of beam lifters further comprises a lifter foot;

the lifter foot being connected to the threaded stud;

the turn handle and the lifter foot being positioned opposite each other along the threaded stud; and the threaded sheath being positioned between the turn handle and the lifter foot.

12. The roofing ladder with a modular angularly adjustable platform as claimed in claim 1 comprises:

the platform assembly comprises a seat plate, a front plate, and a beam attachment plate;

the seat plate being hingedly connected to the front plate by a first hinge connection; and the beam attachment plate being hingedly connected to the front plate opposite the seat plate by a second hinge connection.

13. The roofing ladder with a modular angularly adjustable platform as claimed in claim 12 comprises:

the front plate being selectively constrained to a desired angle relative to the seat plate; and the beam attachment plate being selectively constrained against a topside face of the beam in a desired position along the beam.

14. The roofing ladder with a modular angularly adjustable platform as claimed in claim 12 comprises:

the seat plate comprises a seat body, a pair of attachment hooks and a pair of pin plates;

the pair of attachment hooks being connected to the seat body; and the first hinge connection being positioned opposite the pair of attachment hooks along the seat body.

15. The roofing ladder with a modular angularly adjustable platform as claimed in claim 14 comprises:

the pair of pin plates being oriented parallel to a symmetry reference plane, wherein the pair of pin plates are oriented perpendicular to the seat body;

the pair of pin plates being positioned symmetrically about the symmetry reference plane;

the pair of pin plates being connected to the seat body;

the pair of pin plates being positioned opposite the pair of attachment hooks along the seat body; and the first hinge connection being positioned between the pair of pin plates;

each of the pair of pin plates comprises a plurality of seat plate pin holes angularly distributed on the pin plate along a circular arc, wherein a center of the circular arc is aligned with the first hinge connection.

16. The roofing ladder with a modular angularly adjustable platform as claimed in claim 14 comprises:

the front plate comprises a pair of front plate pin holes;

the pair of front plate pin holes being oriented perpendicular to a symmetry reference plane;

the pair of front plate pin holes traversing into the front plate;

the pair of front plate pin holes being positioned opposite each other on the front plate;

each of the pair of front plate pin holes being selectively aligned with one of a plurality of seat plate pin holes from the pair of pin plates by rotating the front plate about the first hinge connection; and a pair of front plate pins being removably inserted through one of the plurality of seat plate pin holes and the pair of front plate pin holes, wherein the front plate is angularly fixed relative to the seat plate by inserting the pair of front plate pins through one of the plurality of seat plate pin holes and the pair of front plate pin holes.

17. The roofing ladder with a modular angularly adjustable platform as claimed in claim 14 comprises:

the beam attachment plate comprises a plurality of beam attachment pin holes;

the plurality of beam attachment pin holes being linearly spaced apart along the beam attachment plate; and a beam attachment pin being removably inserted through one of the plurality of beam attachment pin holes and one of the beam pin holes, wherein the beam attachment plate is affixed to the beam by inserting the beam attachment pin through one of the plurality of beam attachment pin holes and one of the beam pin holes.

18. The roofing ladder with a modular angularly adjustable platform as claimed in claim 1 comprises:

a lower bracket comprising a pair of hook arms, a support plate, and a lower attachment plate;

each of the pair of hook arms comprises a plurality of hooks;

the plurality of hooks being positioned linearly adjacent to each other along the pair of hook arms;

the lower attachment plate being hingedly connected to the support plate;

the pair of hook arms being hingedly connected to the support plate opposite the lower beam attachment plate;

the lower attachment plate comprises a lower attachment plate pin hole;

the lower attachment plate being removably attached to an underside face of the beam by inserting a pin through one of the plurality of beam pin holes and through the lower attachment plate pin hole; and one of the plurality of hooks being removably attached to one of the step rods, wherein the orientation for the support plate is determined by which of the plurality of hooks is attached to the one of the step rods;

wherein the one of the step rods is positioned adjacent to the one of the plurality of beam pin holes along the beam.

* * * * *